US006222133B1

(12) United States Patent
St. Louis

(10) Patent No.: US 6,222,133 B1
(45) Date of Patent: Apr. 24, 2001

(54) ONE-PIECE CERAMIC TERMINAL INSULATOR MOUNTING ARRANGEMENT

(75) Inventor: Robert Maurice St. Louis, St. Leonard (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/305,308

(22) Filed: May 5, 1999

(51) Int. Cl.[7] ..... H01B 17/00; H05B 3/68

(52) U.S. Cl. ..... 174/138 J; 174/151; 174/153 R; 174/157; 219/459.1; 219/541

(58) Field of Search ..... 174/138 J, 65 R, 174/151, 153 R, 153 G, 153 A, 152 G, 157, 167, 158 R; 219/459.1, 541

(56) References Cited

U.S. PATENT DOCUMENTS

| | | | | |
|---|---|---|---|---|
| 3,708,612 | | 1/1973 | Saxon et al. | 174/142 |
| 4,182,928 | | 1/1980 | Murphy et al. | 174/153 |
| 4,653,708 | | 3/1987 | Rich | 248/27.1 |
| 4,656,340 | * | 4/1987 | St. Louis | 219/532 |
| 4,994,654 | * | 2/1991 | St. Louis | 219/532 |
| 5,134,270 | | 7/1992 | Bragg et al. | 219/532 |
| 5,621,370 | | 4/1997 | St. Louis | 337/380 |
| 5,623,126 | | 4/1997 | Sherrill | 174/153 |
| 5,935,471 | * | 8/1999 | St. Louis | 219/465.1 |
| 6,002,116 | * | 12/1999 | St. Louis | 219/542 |

* cited by examiner

*Primary Examiner*—Dean A. Reichard
*Assistant Examiner*—Charlie Nguyen

(57) ABSTRACT

There is disclosed a one-piece ceramic terminal suitable for use for mounting an electrical conductor in insulated relation to a supporting wall of a heating assembly. The ceramic insulator has a central block adapted to pass through a central portion of an aperture in the supporting wall. This aperture has two radially extending slots extending outwardly of the central portion. The ceramic terminal includes a first pair of diametrically opposed radially extending wings which are sized to pass through the radially extending slots in the aperture. The ceramic insulator has a second pair of diametrically opposed radially extending wings which are sized larger than the slots in the aperture so as to engage one surface of the supporting wall. Once the first set of wings pass through the aperture and corresponding slots, the ceramic insulator is rotated such that the second set of wings engage the other surface of the supporting wall so as to mount the insulator relative to the supporting wall. An electrical conductor passes through a central slot in the ceramic insulator and is bent to prevent the insulator from rotating relative to the aperture in the supporting wall and prevent disengagement insulator from the supporting wall.

10 Claims, 5 Drawing Sheets

ONE-PIECE CERAMIC TERMINAL INSULATOR MOUNTING ARRANGEMENT

FIELD OF THE INVENTION

This invention relates to a one-piece ceramic terminal insulator for use in mounting an electrical connecting terminal through a support wall of an apparatus. In particular, the present invention relates to a ceramic terminal insulator mounting arrangement for use with a heating assembly in a clothes dryer.

BACKGROUND OF THE INVENTION

In the manufacture of heating assemblies for use in clothes dryers, it is common practice to mount a helical coil on insulators relative to a heating housing. Electrical connection of electrical energy to the heating coils is typically provided through a terminal assembly mounted in a sidewall of the heater housing comprising an electrical connector terminal and an insulator.

One such terminal assembly is shown in U.S. Pat. No. 5,623,126 issued to Jimmy L. Sherrill on Apr. 22, 1997. This patent teaches a two piece ceramic insulator comprising male and female parts which cooperate with a relatively flat or blade like terminal connector passing through the male and female members. This two piece ceramic insulator requires the assembly of the two parts relative to the supporting wall and must be held in place while a relatively flat connector terminal blade is passed through a center aperture in the male and female parts. The flat terminal blade has tabs which engage the female portion of the ceramic insulator to limit the travel of the blade terminal through the ceramic insulator. The other end of the terminal blade must be bent in order to maintain the male and female insulator members in mating relationship. This insulator is difficult to assemble because it requires holding the male and female members together while the terminal blade is passed through the insulators. Further, the terminal blade is crimped onto the end of a regular terminal. Accordingly, a disadvantage associated with this ceramic terminal insulator assembly is that it is difficult and labour intensive to assemble through the supporting wall of the heater assembly.

SUMMARY OF THE INVENTION

It is an object of the present invention to provide a one-piece ceramic terminal assembly which is readily mounted through a supporting wall of a heater housing.

The present invention relates to a terminal assembly comprising a one-piece ceramic insulator for mounting an electrical conductor therethrough and relative to a support wall of a heater housing. The insulator has a central block extending along a longitudinal axis and between first and second ends thereof. The central block has a passageway extending through its center between the first and second ends for receiving the electrical conductor. The central block passes through a first aperture in the supporting wall and has a diameter less than the diameter of a central opening in the first aperture. The first aperture has at least one slot extending outward from the central aperture. The insulator includes at least a first wing extending out from the central block adjacent the first end a first distance greater than the diameter of the central opening of the first aperture and less than the at least one slot to permit the passage of the first wing through the first aperture. The insulator includes a second wing extending out from the central block adjacent the second end spaced axially and readily offset of the central block from the first opposing first wing. The second wing is larger than the at least one slot in the supporting wall so as to engage a second opposing side of the supporting wall and prevent the second wing from passing through the first aperture.

Advantage is found with the present invention in that a one-piece insulator does not have to be assembled and can be passed through a supporting wall aperture and rotated such that the first and second wings axially spaced along the central block of the insulator are rotated into engagement with opposing side surfaces of the supporting wall. Such a one-piece ceramic insulator is easy to assemble within the heating assembly. The electrical conductor may be a relatively flat blade member that passes through the passageway in the ceramic insulator.

Another aspect of the one-piece ceramic insulator of the present invention is that the central block may have concave surfaces extending from the first end to the second end of the central block between the first and second wings to define an air gap passageway between the central block and the aperture in the supporting sidewall. This gap allows air to be drawn in across the ceramic insulator towards the heating elements and thereby cool the ceramic insulator and prevent it from overheating due to the passage of electrical current through the electrical conductor.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
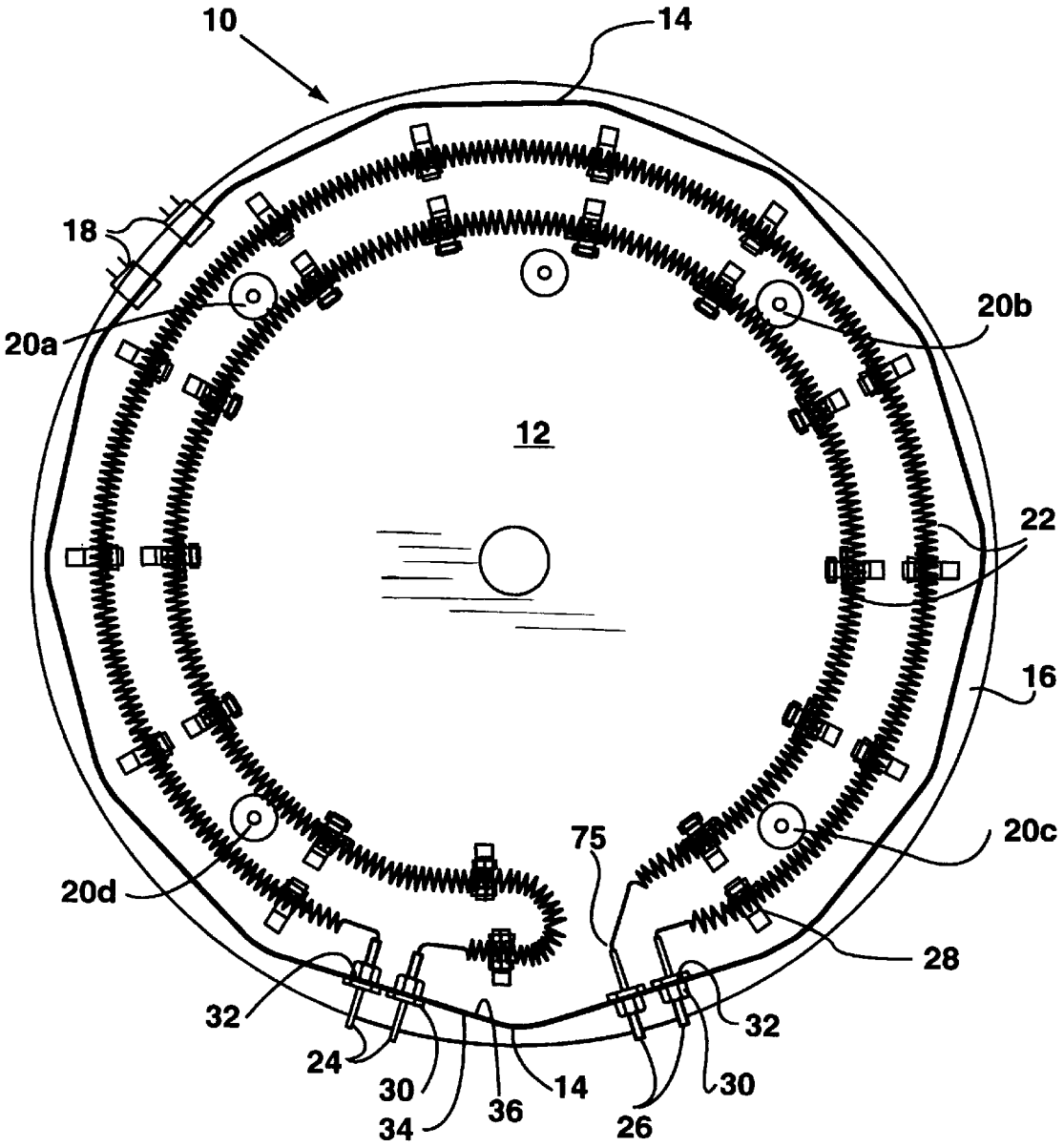
FIG. 1 is an elevation view showing the positioning of heating elements around the perimeter of a dryer support wall and the electrical connection through the dryer support wall utilizing the electrical terminal assembly and mounting arrangement of the present invention.

In FIG. 1, a heater assembly 10 suitable for use in a clothes dryer is shown. The heater housing 10 has a support wall 12 with a peripheral wall 14 and a rim 16. Wall 14 includes first openings for securing thermostats 18 to the heater assembly 10. In the embodiment shown in FIG. 1 four securing bolts 20 *a, b, c* and *d* respectively, are shown for further retaining the heater assembly 10 in place relative to the dryer (not shown). Two helical wound heater coils 22 extends around the perimeter of support wall 12. Heater coils 22 are retained in position by a series of heater coil mounting support brackets 28 that are secured to the support wall 12. One end of the heater coils 22 is connected to a power source via electrical conductor terminals 24, and the other ends is connected to electrical conductor terminals 26.

Conductors 24 and 26 pass through electrical insulators 30. The insulators 30 pass through terminal apertures 32 in the supporting wall 14. The insulators 30 are mounted to the supporting wall 14 engaging first and second opposing sides 34, 36 of the supporting wall 14. In FIG. 1, insulators 30 supporting terminals 24 are shown mounted through the supporting wall 14 in an opposite manner to the insulators 30 supporting terminals 26.

Figure 4A:
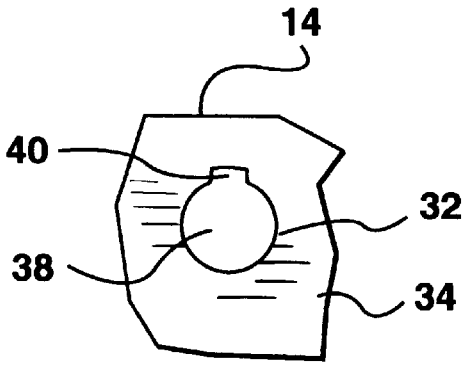
FIGS. 4*a*, 4*b*, and 4*c* illustrate an end view of the assembly of the insulator in the supporting wall.
Figure 6A:
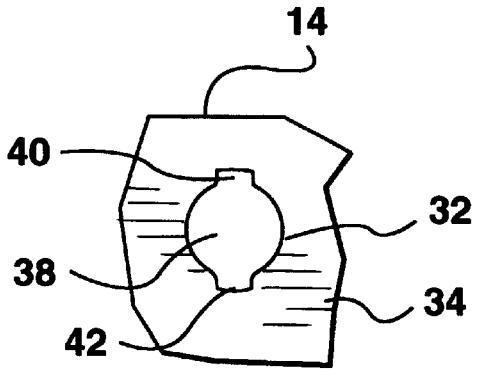

Referring to FIGS. 4A and 6A, a portion of the supporting wall 14 looking at the outside surface 34 is shown to include the terminal or first aperture 32 passing through the supporting wall 14. In the embodiment of FIG. 4A, the first aperture 32 has a central opening 38 and one slot 40 extending outwardly from the central opening 38 of the first aperture 32. In the embodiment shown if FIG. 6A, the aperture 32 has a central opening 38 with a pair of slots 40, 42 extending outwardly from the central opening 38 and being radially diametrically opposed from one another. The use of one or two slots 40, 42 has an effect on the positioning of the insulator 30 relative to the aperture 32 during the insertion of the insulator 30 through the sidewall 14. These differences will be explained in more detail hereinafter.

Figure 2:
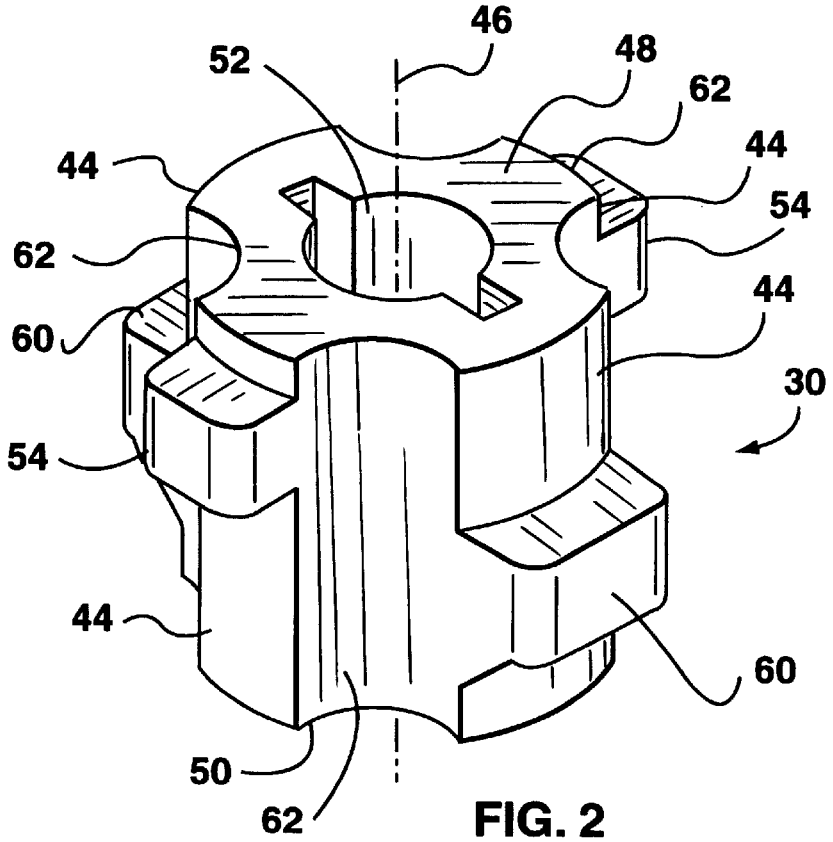
FIG. 2 is an isometric view of the one-piece terminal of the present invention.
Figure 3:
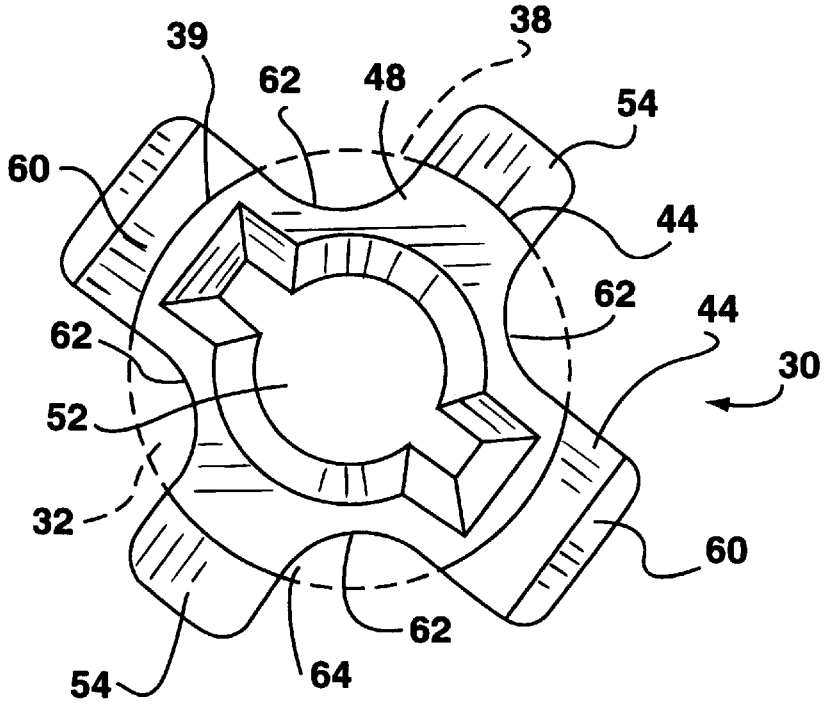
FIG. 3 is an end view of the one-piece terminal insulator.

Referring to FIGS. 2 and 3 there is shown the one-piece ceramic insulator of the present invention. The ceramic insulator 30 has a central block 44 having a generally circular diameter at its outer surfaces. The central block 44 extends along a longitudinal axis 46 between first and second ends 48, 50 of the central block 44. The central block 44 has a passageway 52 extending therethrough between the first and second ends 48 and 50 for receiving one of the electrical conductor terminals 24, 26 (see FIG. 1). The passageway 52 is a circular passage with slotted sides so as to receive a relatively flat terminal assembly blade like shaped terminal or circular terminal. The central block 44 has a diameter 39 that is less than the diameter 38 of the first aperture 32.

The central block 44 includes a first pair of diametrically opposed first wings 54 which extend out from the central block 44 adjacent the first end 48 a distance which is greater than the diameter of the central opening 38 and less than the at least one slot 40, 42.

The central block 44 further includes a second pair of diametrically opposed second wings 60 which extend out from the central block 44 adjacent the second end 50. The second pair of wings 60 are spaced axially along the longitudinal axis 46 from the first pair of wings 54. Further, the second pair of wings 60 are offset radially relative to the first pair of wings 54. The second wings 60 are larger in size than the slots 40, 42 so as to engage one of the sides of the supporting wall 14.

The central block 44 further includes concave shaped surfaces 62 that extend between the first and second ends 48, 50 of the central block 44 and between the first and second wings 54, 60. The concave surfaces 62 define an air gap 64 between the concave surface 62 and the central opening 38 of the aperture 32 which is shown in FIG. 3 between the concave surface 62 and dotted line 38 representing the central opening of the aperture 32.

Referring now to FIGS. 4A, 4B, 4C and FIG. 5, the assembly of the insulator 30 relative to the supporting wall 14 will now be described for the insulators 30 that support terminal 26 in FIG. 1. It should be understood that this method of assembly may be used for the insulators 30 that support terminals 24 when inserted through the supporting wall 14 from the opposite direction.

To insert the terminal 30 through aperture 32 in the supporting wall 14, the terminal 30 is moved as shown in FIG. 5(A) towards the surface 32 of the supporting wall 14. As the terminal 30 is moved towards supporting surface 32, it is angled so that the lower wing 54 passes through the central opening 38 of the aperture 32. Next the terminal 30 is pivoted as shown in FIGS. 5(B), (C), and (D), so that the upper wing 54 passes through the slot 40 in the aperture 32. At this time, the larger second wings 60 engage the surface 32 preventing any further forward movement of the terminal 30 through the aperture 32.

Figure 4B:
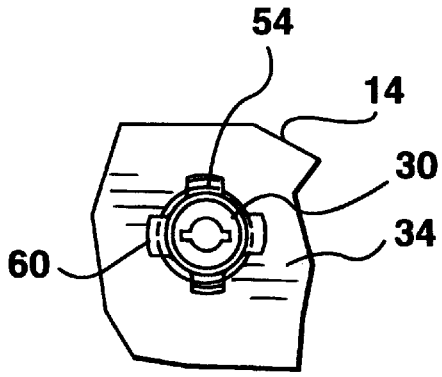
Figure 4C:
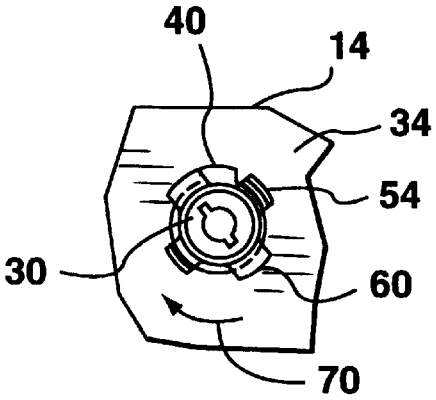

FIG. 4B shows the mounting of the insulator 30 through the aperture 32 in end view. The insulator 30 is then rotated in the direction of arrow 70 shown in FIG. 4C so as to rotate the wings 54 relative to the slot 40 and bring the wings 54 into engagement with surface 34 of the supporting wall 14.

Figure 5:
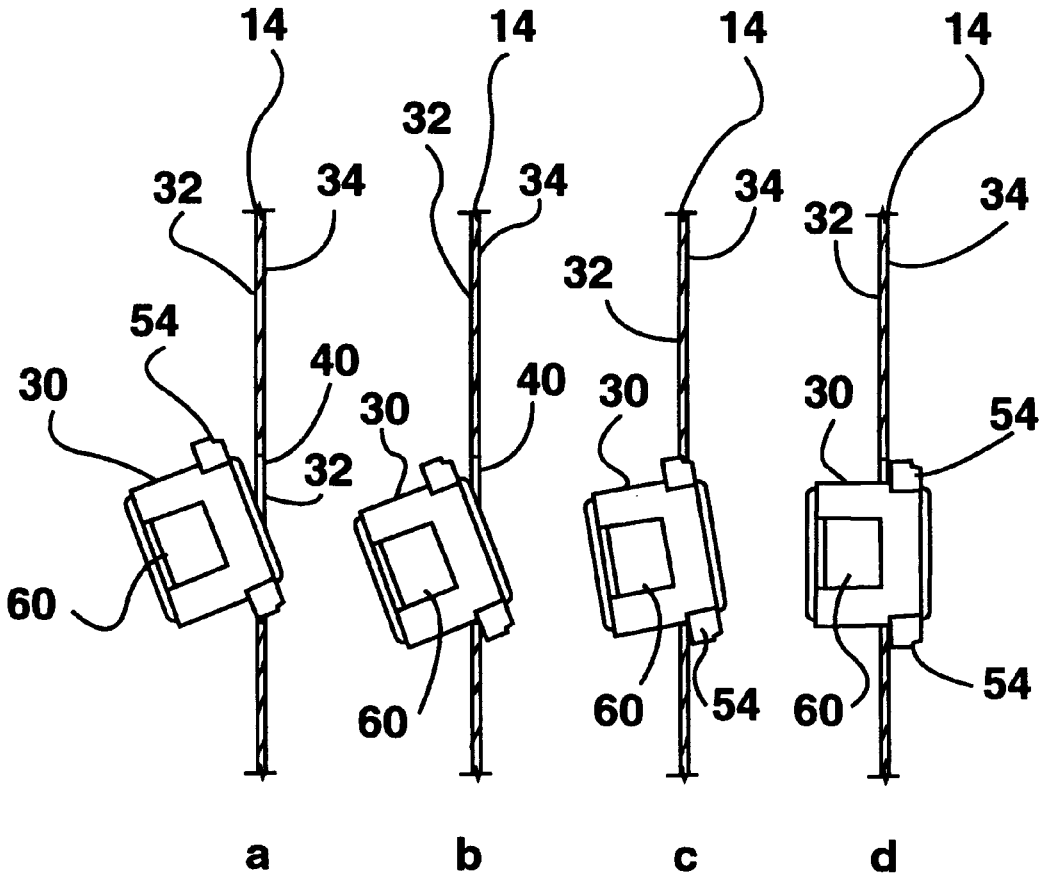
FIG. 5 is a side view showing the steps involved to insert the insulator through th supporting wall; and, FIG. 6*a*, 6*b*, and 6*c* illustrate and end view of the assembly of the insulator in the supporting wall wherein the aperture in the supporting wall has two diametrically opposed radially extending slots.
Figure 6B:
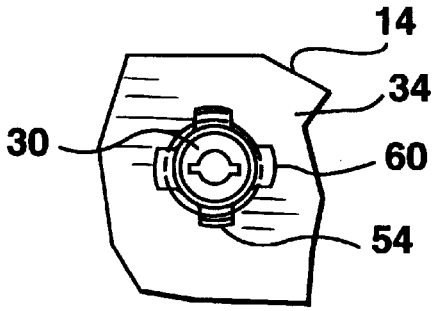
Figure 6C:
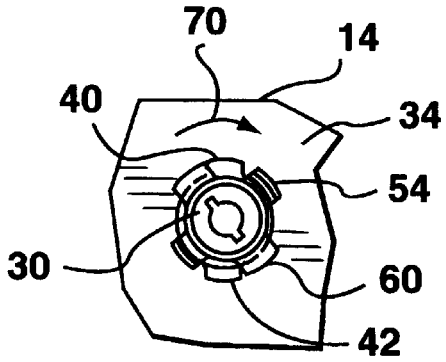

The difference between the method of assembly shown in FIGS. 4 and 5 relative to that shown in FIG. 6 is that the additional aperture 42 shown in FIG. 6A permits the direct insertion of the insulator 30 through the aperture 32 without having to first insert one wing 54 and pivot the other wing through slot 40. Again, the insulator 30 is rotated in the direction of the arrow 70 to move the insulator into position. While arrows 70 are shown rotating the insulator in a clockwise fashion, it should be understood that the insulator could be rotated in a counterclockwise direction if this was more appropriate.

The electrical conductor terminals 26 are pushed through the passageway 52 and bent as shown in FIG. 1 at 75. This prevents the terminal block 30 from rotating relative to the aperture 32 and disengaging itself from the aperture. It should be understood that electrical conductor terminals 24, 26 can be pre-assembled to insulators 30 prior to the insulators 30 being assembled to the supporting wall 14. Further, the conductor terminals 24, 26, alternatively can be bent against one of the ends 48, 50 of the insulator 30 to prevent rotation of the insulator 30.

From the foregoing it will be seen that the use of a one-piece ceramic insulator with electrical contact may be readably mounted through a supporting wall of the heating assembly.

What I claim is:

1. An electrical terminal assembly and mounting arrangement in an apparatus having a supporting wall with first and second opposing sides, the electrical terminal assembly being mounted to the supporting wall in engagement with the first and second opposing sides of the supporting wall, the mounting arrangement comprising:

a first aperture passing through the supporting wall, the first aperture having a central opening with at least one slot extending outward from the central opening of the first aperture; and, the electrical terminal assembly comprising a one-piece ceramic insulator and an electrical conductor, the insulator comprising:

a central block extending along a longitudinal axis between first and second ends thereof, having a passageway extending therethrough between the first and second ends, and having a diameter less than the diameter of the central opening of the first aperture;

a first wing extending out from the central block adjacent the first end a first distance greater than the diameter of the central opening and less than the at least one slot to permit the passage of the first wing though the first aperture, and the first wing adapted to engage the first opposing side of the supporting wall upon rotation of the central block relative to the first aperture; and a second wing extending out from the central block adjacent the second end spaced axially and radially offset on the central block from the first wing, the second wing being larger than the at least one slot to engage the second opposing side of the supporting wall and prevent the second wing form passing through the first aperture; and, the electrical conductor passing through the passageway.

2. The electrical terminal assembly and mounting arrangement of claim 1 wherein the electrical conductor is bent to prevent rotational movement of the central block relative to the first aperture.

3. The electrical terminal assembly and mounting arrangement of claim 1 wherein the first aperture has two slots extending outward in diametrical opposition from the central opening of the first aperture.

4. The electrical terminal assembly and mounting arrangement of claim 1 wherein the central block has concave surfaces extending from the first end to the second end between the first and second wings to define air gaps between the first aperture and the concave surfaces of the central block.

5. An electrical terminal assembly and mounting arrangement in an apparatus having a supporting wall with first and second opposing sides, the electrical terminal assembly being mounted to the supporting wall in engagement with the first and second opposing sides of the supporting wall, the mounting arrangement comprising:

a first aperture passing through the supporting wall, the first aperture having a central opening with at least one slot extending outward from the central opening of the first aperture; and, the electrical terminal assembly comprising a one-piece ceramic insulator and an electrical conductor, the insulator comprising:

a central block extending along a longitudinal axis between first and second ends thereof, having a passageway extending therethrough between the first and second ends, and having a diameter less than the diameter of the central opening of the first aperture, a first pair of diametrically opposed first wings extending out from the central block adjacent the first end a first distance greater than the diameter of the central opening and less than that of the at least one slot to permit the passage of the first wings though the first aperture, and the first wings adapted to engage the first opposing side of the supporting wall upon rotation of the central block relative to the first aperture; and a second pair of diametrically opposed second wings extending out from the central block adjacent the second end spaced axially and radially offset on the central block from the first pair of first wings, the second wings being larger than the at least one slot to engage the second opposing side of the supporting wall and prevent the second wings form passing through the first aperture; and, the electrical conductor passing through the passageway.

6. The electrical terminal assembly and mounting arrangement of claim 5 wherein the electrical conductor is bent to prevent rotational movement of the central block relative to the first aperture.

7. The electrical terminal assembly and mounting arrangement of claim 5 wherein the first aperture has two slots extending outward in diametrical opposition from the central opening of the first aperture.

8. The electrical terminal assembly and mounting arrangement of claim 5 wherein the central block has concave surfaces extending from the first end to the second end between the first and second wings to define air gaps between the first aperture and the concave surfaces of the central block.

9. A one-piece ceramic electrical insulator for mounting an electrical conductor through an apparatus having a supporting wall with first and second opposing sides and a first aperture passing in the supporting wall having a central opening with at least one slot extending outward from the central opening, the electrical insulator comprising:

a central block extending along a longitudinal axis between first and second ends thereof, having a passageway extending therethrough between the first and second ends for receiving the electrical conductor, and having a diameter less than the diameter of the central opening of the first aperture;

a first wing extending out from the central block adjacent the first end a first distance greater than the diameter of the central opening and less than that of the at least one slot to permit the passage of the first wing though the first aperture, and the first wing adapted to engage the first opposing side of the supporting wall upon rotation of the central block relative to the first aperture; and a second wing extending out from the central block adjacent the second end spaced axially and radially offset on the central block from the first wing, the second wing being larger than the at least one slot to engage the second opposing side of the supporting wall and prevent the second wing form passing through the first aperture.

10. The electrical insulator of claim 9 wherein the central block has concave surfaces extending from the first end to the second end between the first and second wings to define air gaps between the first aperture and the concave surfaces of the central block.

* * * * *